United States Patent [19]

Zumbuhl

[11] Patent Number: 4,739,893

[45] Date of Patent: Apr. 26, 1988

[54] LINERLESS PLASTIC CLOSURE WITH INTEGRAL SEALING RING

[75] Inventor: Bruno Zumbuhl, Sugarloaf, Pa.

[73] Assignee: Zapata Industries, Inc., Frackville, Pa.

[21] Appl. No.: 903,501

[22] Filed: Sep. 4, 1986

[51] Int. Cl.[4] ..... B65D 53/00

[52] U.S. Cl. ..... 215/344; 215/DIG. 1

[58] Field of Search ..... 215/344, DIG. 1, 329

[56] References Cited

U.S. PATENT DOCUMENTS

| | | | |
|---|---|---|---|
| 3,055,526 | 9/1962 | Plunkett | 215/344 X |
| 3,203,571 | 8/1965 | Plunkett | 215/344 |
| 3,331,523 | 7/1967 | Exton | 215/40 |
| 3,802,590 | 4/1974 | Culver | 215/344 |
| 3,948,405 | 4/1976 | Yonker | 215/344 |
| 4,072,244 | 2/1978 | Mueller | 215/344 |
| 4,526,284 | 7/1985 | Herbert | 215/329 |
| 4,623,070 | 11/1986 | Nishikawa | 215/344 X |

FOREIGN PATENT DOCUMENTS

| | | | |
|---|---|---|---|
| 274657 | 9/1969 | Austria . | |
| 1107541 | 5/1961 | Fed. Rep. of Germany | 215/DIG. 1 |
| 1213812 | 11/1959 | France . | |

*Primary Examiner*—Donald F. Norton

*Attorney, Agent, or Firm*—Shapiro and Shapiro

[57] ABSTRACT

A linerless plastic closure has an integral frusto-conical sealing ring that seals with the rim of the neck of a container when the closure is applied thereto. The sealing ring has a hinge portion at an upper end thereof with a wall thickness that is small relative to that of an adjacent portion of the sealing ring, and has a preformed internal circumferential bead positioned to engage the rim at or near its top inner region. As the closure is applied to the container, the outer portion of the sealing ring first engages the rim, and the sealing ring is easily deformed by virtue of the hinge portion. After the bead seats on the rim, the sealing ring is stretched outwardly completely over the rim, with the bead serving to resist stretching from the hinge portion. An internal circumferential shoulder extends downwardly from the inner surface of the top wall adjacent to the side wall of the closure, engages the outer portion of the sealing ring, shapes the sealing ring to the rim, and clamps the outer portion of the sealing ring to the top outer region of the rim.

9 Claims, 2 Drawing Sheets

LINERLESS PLASTIC CLOSURE WITH INTEGRAL SEALING RING

This invention is concerned with linerless plastic closures for containers such as bottles and jars and is more particularly concerned with the provision of an improved fluid-tight seal between the closure and the container.

BACKGROUND OF THE INVENTION

Container closures are well known in which an integral sealing ring, rather than a separate liner or gasket, provides a seal upon the top rim of the neck of a bottle or jar. Such closures, usually referred to as linerless closures or caps, are disclosed, for example, in U.S. Pat. Nos. 3,055,526; 3,203,571; 3,802,590; 3,948,405; 4,072,244; and 4,526,284, and in Austrian Pat. No. 274,657 and French Pat. No. 1,213,812. The sealing ring may be frusto-conical and extend downwardly and outwardly from an inner surface of the top wall of the closure or downwardly and inwardly from that surface. The same general seal configuration may be provided by a separate sealing ring or liner, as disclosed, for example, in U.S. Pat. No. 3,331,523.

Linerless closures are usually molded in one piece from plastic resin, such as polypropylene, polyethylene or other types of plastic material, as disclosed, for example, in the aforesaid U.S. Pat. No. 3,055,526. The rigidity of the closure and its parts may be controlled by the choice of plastic material and by the part thicknesses.

BRIEF DESCRIPTION OF THE INVENTION

The present invention provides an improved linerless plastic closure that is easily applied to a container, that forms a seal with the container that is capable of withstanding high fluid pressures when the closure is initially applied and even after the closure is removed and reapplied, and that can be easily and economically manufactured by injection molding, for example. In one of its broader aspects the invention provides a linerless plastic closure for sealing engagement with the neck of a container having a top rim, the closure comprising a top wall and an integral side wall having means for attaching the closure to the neck of the container, and a frusto-conical sealing ring integral with the top wall and extending downwardly and outwardly from an inner surface thereof, the sealing ring having a hinge portion at an upper end thereof that has small wall thickness relative to the wall thickness of an adjacent portion, and having a preformed internal circumferential bead below the hinge portion positioned to engage the rim of the container neck at or adjacent to a top inside region thereof, the sealing ring also having an outer portion extending downwardly and outwardly from the bead and positioned so as to engage the rim and be stretched over the rim while the bead engaged with the rim resists outward stretching of the sealing ring from the hinge portion.

In another of its broader aspects the invention provides in combination with a container having a neck with a rim at the top thereof, a plastic closure comprising a top wall, a side wall having means for attaching the closure to the neck, and a frusto-conical sealing ring integral with the top wall, the sealing ring extending downwardly and outwardly from an inner surface of the top wall and being positioned to engage the rim of the neck as the closure is applied to the container, the sealing ring having a hinge portion at an upper end thereof that has wall thickness small relative to the wall thickness of an adjacent portion of the sealing ring, the sealing ring also having a preformed internal circumferential bead positioned to engage the rim at or near the top inner region thereof and having an outer portion extending downwardly and outwardly from the bead and positioned to engage the rim and to be stretched outwardly over the rim, with the bead engaged with the rim resisting outward stretching of the sealing ring from the hinge portion.

BRIEF DESCRIPTION OF THE DRAWINGS

The invention will be further described in conjunction with the accompanying drawings, which illustrate a preferred (best mode) embodiment and wherein.

DETAILED DESCRIPTION OF PREFERRED EMBODIMENT

Figure 1:
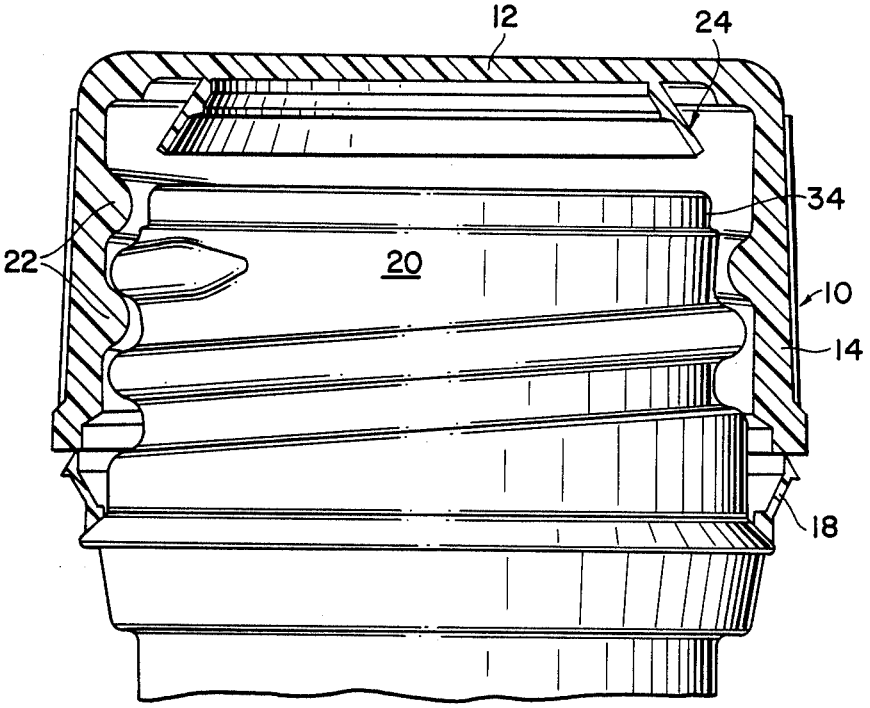
FIG. 1 is a vertical sectional view showing a closure in accordance with the invention being applied to the neck of a container.

As shown in FIG. 1, a closure 10 in accordance with the invention comprises a top wall 12 and an integral cylindrical side wall 14, sometimes referred to as the "skirt." The closure is preferably formed of plastic material molded in one piece, as by injection molding. While polypropylene is the preferred material, other plastics may be used as noted earlier.

Figure 2:
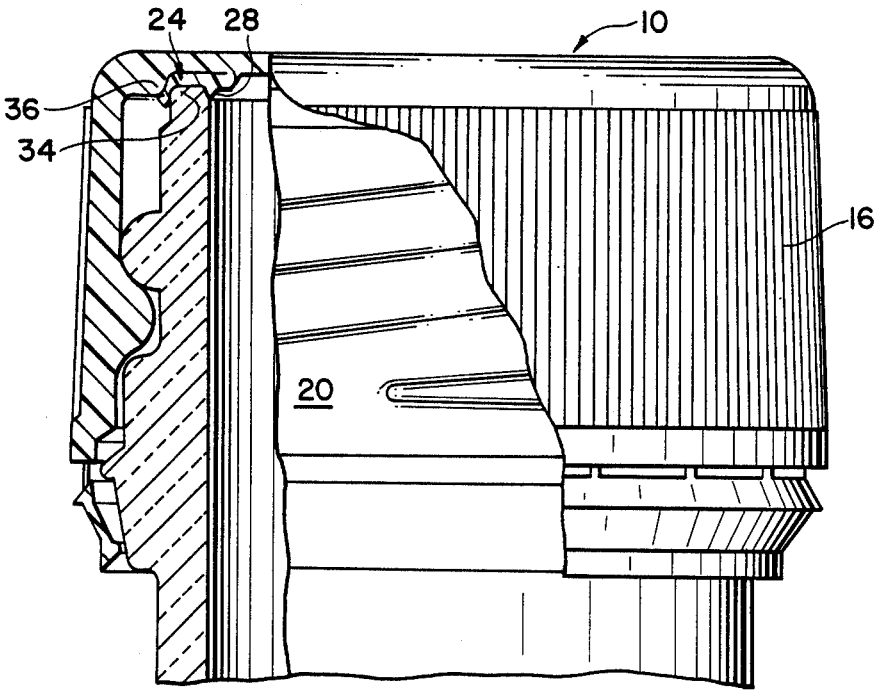
FIG. 2 is an elevational view, partly broken away and in section, showing the closure after it has been applied to the container.

The outer surface of the side wall is preferably knurled as shown at 16 in FIG. 2, and the lowermost portion of the side wall 14 may have an integral tamper-evident ring 18 when this feature is desired. One form of tamper-evident ring, which is attached to the lower edge of the side wall 14 by circumferentially spaced frangible bridges, as well known in the art, is illustrated in the drawings, but the present invention does not require that ring or any ring at all.

The closure of the invention is shown in conjunction with the externally threaded neck 20 of a bottle, which may be a glass bottle manufactured in accordance with GCMI (Glass Container Manufacturers Institute) standards, although closures in accordance with the invention can be used with other types of containers, such as plastic bottles, or jars. An important attribute of the invention is its versatility and adaptability to a wide variety of container types with excellent sealing. For example, the closures of the invention may be used with glass or plastic beverage bottles containing pressurized or unpressurized beverages, or with plastic bottles containing motor oil. In the preferred embodiment illustrated, the inner surface of the side wall 14 of the closure has internal threads 22 that complement the external threads of the neck 20 of the container, so that the closure may be applied to and removed from the container by rotating the closure about its vertical axis, but other forms of attachment of the closure to the container are possible.

Figure 3:
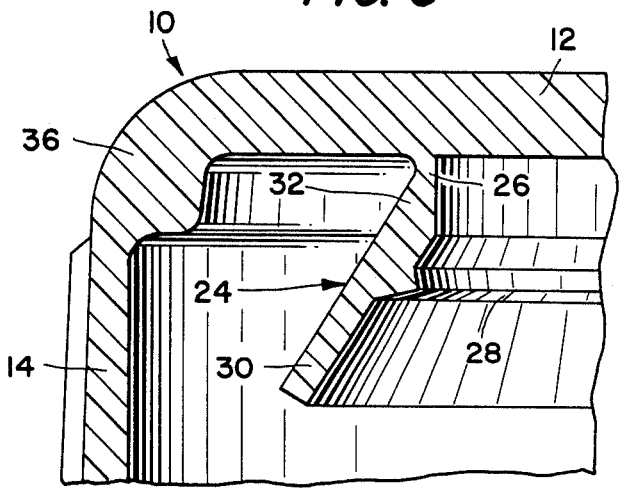
FIG. 3 is a fragmentary vertical sectional view of the closure prior to its application to the container.

As shown in FIGS. 1 and 3, the closure of the invention has an integral frusto-conical sealing ring 24 extending downwardly and outwardly from an internal surface of the top wall 12. At the upper end of the sealing ring where it merges with the top wall, the sealing ring has a hinge portion 26 of reduced wall thickness relative to the wall thickness of an adjacent portion of the sealing ring. The sealing ring also has a preformed, integral internal circumferential bead 28 at a lower portion. The bead is preferably of V-shaped cross-section in vertical planes. Incidentally, terms such as "top", "side", "bottom", and "vertical" assume that the parts referred to have the orientations illustrated in the drawings, i.e., with the axes of the closure and the container vertical. Such terms are used for ease of description and are not intended to limit the invention to a particular orientation. As shown in FIG. 3, the sealing ring has an outer portion 30 that extends downwardly and outwardly beyond the bead 28. Preferably the outer portion has a rectangular cross-section in vertical planes, the wall thickness of which is somewhat less than the thickness of the portion 32 between the hinge portion 26 and the bead 28, although variations are possible.

FIG. 1 shows the position of the sealing ring 24 relative to the rim 34 at the top of the neck 20 of the container as the closure 10 is applied to the neck but prior to the formation of a seal. FIG. 2 shows the closure fully engaged with the neck of the container and with the sealing ring 24 engaging the rim 34.

Comparing FIGS. 1 and 2, it will be apparent that the bottom of the outer portion 30 of the sealing ring 24 first engages the top of the rim 34. As the closure continues to be threaded onto the neck 20, the sealing ring is forced downwardly over the rim 34 and is deformed outwardly from the hinge portion 26 so that the rim enters the interior of the sealing ring. This action continues, with outward hinging being provided by the hinge portion 26, which is thin enough to permit easy deformation of the sealing ring. When the closure has been applied to an extent at which the bead 28 engages the rim 34, the bead seats itself at or near the top inner region of the rim as shown in FIG. 2. This engagement of the bead with the rim provides resistance to further stretching from the hinge portion 26, thereby preventing damage to the relatively thin hinge portion, and also forms an excellent seal at the engagement region. Further downward movement of the closure relative to the neck of the container causes the outer portion 30 of the sealing ring to be stretched completely over the rim 34, with the bead 28 anchoring the inner portion 32 of the sealing ring.

As shown in FIG. 3, the closure has an integral internal circumferential shoulder 36 that extends downwardly from the inner surface of the top wall 12 adjacent to the side wall 14, in other words, at the region where the top wall and side wall merge. The cross-section of the shoulder is right-angular in vertical planes. The sealing ring 24 extends outwardly far enough to cause the outer portion 30 to engage the shoulder 36 as the sealing ring is being stretched over the rim 34, thereby shaping the sealing ring to the rim and clamping the sealing ring to the top outer region of the rim, as shown in FIG. 2. A particular virtue of the invention is that sealing is provided over the entire rim from its top inner region to its top outer region, and particularly at the top outer region, which, in accordance with conventional bottle manufacturers' standards, is held closely to a predetermined dimension, unlike the top inner region of the rim. Thus, excellent sealing is provided despite tolerance variations. In actual tests in which closures of the invention have been applied to glass bottles manufactured in accordance with GCMI standards, seals provided in accordance with the invention have remained fluidtight even when the containers to which the closures have been applied have been pressurized to 200 psi.

Figure 4:
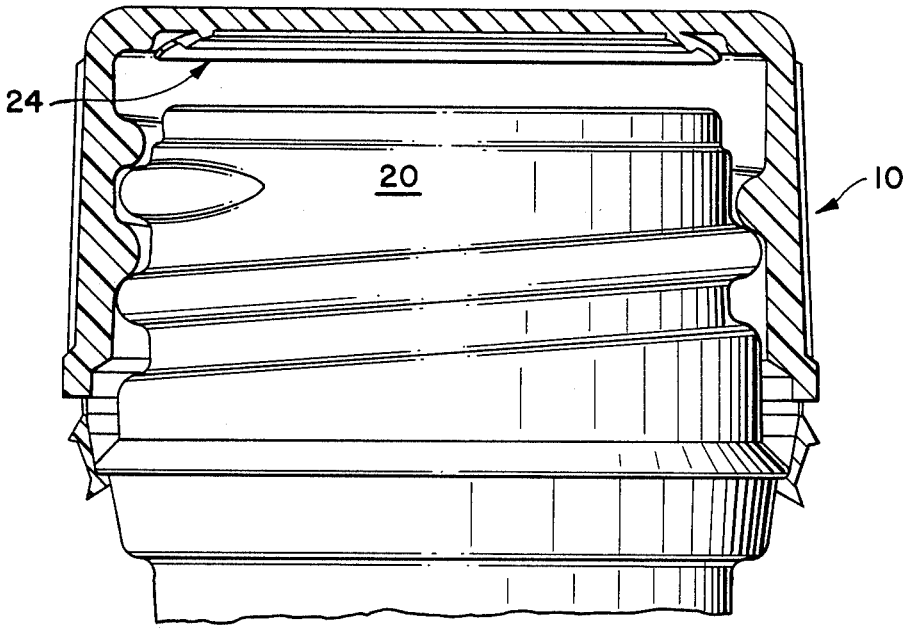
FIG. 4 is a view similar to FIG. 1 but showing the closure as it is being removed from the container.

As is apparent in FIG. 4, which illustrates a closure of the invention partially removed from the neck of a bottle, the sealing ring 24 is permanently deformed by the stretching that occurs during application of the closure to the bottle. Nevertheless, when the closure is reapplied to the bottle, excellent sealing is attained again.

In an actual embodiment, a plastic closure of the invention has a height (exclusive of the tamperevident ring and its bridges) of 0.575 inch, an outer diameter at the top of the side wall of 1.145 inch, an inner diameter at the top of the side wall of 1.095 inch, and a top wall thickness of 0.045 inch. The sealing ring 24 has an inner surface extending vertically downward from the top wall at a top wall diameter of 0.744 inch, the vertical drop being 0.049 inch, at which point the inner surface extends downwardly and outwardly at an angle of 58 degrees with respect to the inner surface of the top wall, the outer surface of the sealing ring extending downwardly and outwardly at the same angle. The length of the sealing ring from its upper end to its lower end is 0.170 inch, and the wall thickness of the outer portion 30 is 0.024 inch. The wall thickness of the hinge portion 26 is 0.010 inch, and the wall thickness of the portion 32 just above the bead 28 is 0.028 inch. The vertex of the bead 28 is 0.007 inch inwardly of the adjacent inner surface of portion 32 and is located 0.032 inch from the point at which the inner surface of the sealing ring commences to extend outwardly. The surfaces of the bead 28 form an angle of 90 degrees.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A linerless plastic closure for sealing engagement with the neck of a container having a top rim, the closure comprising a top wall and an integral side wall having means for attaching the closure to the neck of the container, and a frusto-conical sealing ring integral with the top wall and extending downwardly and outwardly from an inner surface thereof, the sealing ring having a hinge portion located at a junction of an upper end thereof with said inner surface, said hinge portion having a wall thickness that is sufficiently small relative to the wall thickness of an adjacent portion of said sealing ring to ensure hinging of said sealing ring at said junction when said closure is applied to the container, said sealing ring having a preformed internal circumferential bead spaced from said hinged portion and positioned to engage said rim of the container neck at or adjacent to a top inside region thereof, said sealing ring also having an outer portion extending downwardly and outwardly from said bead and positioned so as to engage said rim and be stretched over the top and outside of said rim while said bead engaged with said rim resists outward stretching of said sealing ring from said hinge portion.

2. A closure in accordance with claim 1, wherein the closure has an internal circumferential shoulder below said inner surface of the top wall and adjacent to the side wall of the closure, and wherein the sealing ring extends outwardly sufficiently to engage said shoulder at the outer portion of the sealing ring when the closure is applied to the container so as to shape the sealing ring to said rim and to clamp the sealing ring between the shoulder and the top outer region of the rim.

3. A closure in accordance with claim 1, wherein said bead has a substantially V-shaped cross-section in vertical planes.

4. In combination with a container having a neck with a rim at the top thereof, a plastic closure comprising a top wall, a side wall having means for attaching the closure to the neck, and a frustoconical sealing ring integral with the top wall, the sealing ring extending downwardly and outwardly from an inner surface of the top wall and engaging the rim of the neck, the sealing ring having a hinge portion located at a junction of an upper end thereof with said inner surface, said hinge portion having a wall thickness that is sufficiently small relative to the wall thickness of an adjacent portion of the sealing ring to ensure hinging of said sealing ring at said junction in response to the engagement of said sealing ring with said rim of the neck of the container, the sealing ring also having a preformed internal circumferential bead engaging said rim at or near the top inner region thereof and having an outer portion extending outwardly from the bead and engaging the rim and being stretched outwardly over the top and outside of the rim, with the bead engaged with the rim resisting outward stretching of the sealing ring from the hinge portion.

5. The combination of claim 4, wherein the closure has an internal circumferential shoulder extending downwardly from said inner surface of the top wall adjacent to the side wall of the closure, the sealing ring extending outwardly sufficiently to cause the outer portion of the sealing ring to engage the shoulder, the shoulder shaping the sealing ring to the rim and clamping the outer portion of the sealing ring to the top outer portion of the rim.

6. The combination of claim 4, wherein said bead is spaced from said hinge portion.

7. In combination with a container having a neck with a rim at the top thereof, a plastic closure comprising a top wall, a side wall having means for attaching the closure of the neck, and a sealing ring integral with the top wall, the sealing ring extending downwardly and outwardly from an inner surface of the top wall and engaging the rim of the neck, the sealing ring having a hinge portion extending from a junction of the sealing ring with said inner surface, having a preformed circumferential bead spaced from said junction and engaging said rim at or near the top inner region thereof, and having an outer portion extending outwardly from the bead and being stretched over the top and outside of the rim, with the bead engaged with the rim resisting stretching of said sealing ring between said junction and said bead.

8. The combination of claim 7, wherein the closure has an internal circumferential shoulder extending downwardly from said inner surface of the top wall adjacent to the side wall of the closure, the shoulder engaging the outer portion of the sealing ring, shaping the sealing ring to the rim, and clamping the outer portion of the sealing ring to the top outer portion of the rim.

9. The combination of claim 7, wherein said bead is spaced from said hinge portion.

* * * * *